United States Patent [19]

Parnham

[11] Patent Number: 4,837,879

[45] Date of Patent: Jun. 13, 1989

[54] THERAPEUTIC MATTRESS HAVING LUMBAR SUPPORT MEMBER

[76] Inventor: Leon Parnham, Box 91, Middle Brighton, Australia, 3186

[21] Appl. No.: 88,097

[22] Filed: Aug. 21, 1987

[51] Int. Cl.[4] ..... A47C 27/14

[52] U.S. Cl. ..... 5/446; 5/464; 5/481

[58] Field of Search ..... 5/446, 447, 464, 462, 5/465, 448, 481

[56] References Cited

U.S. PATENT DOCUMENTS

| | | | |
|---|---|---|---|
| 364,797 | 6/1887 | Brooks | 5/448 |
| 1,045,228 | 11/1912 | Weltmer | 5/434 |
| 2,612,158 | 12/1950 | Manley . | |
| 3,378,861 | 4/1968 | Louseberg | 5/446 |
| 4,161,045 | 7/1979 | Regan | 5/447 |
| 4,620,337 | 4/1986 | Williams et al. | 5/464 |

FOREIGN PATENT DOCUMENTS

| | | | |
|---|---|---|---|
| 6900803 | 1/1969 | Fed. Rep. of Germany | 5/465 |
| 2357267 | 5/1975 | Fed. Rep. of Germany | 5/447 |
| 2067897 | 8/1981 | United Kingdom | 5/462 |

*Primary Examiner*—Alexander Grosz

*Attorney, Agent, or Firm*—Roland Plottel

[57] ABSTRACT

A lumbar support mattress having a planar foam cushion with peaks and valleys of resilient material across one surface of the cushion. A curvilinear lumbar support member is adhered at the lower surface of the overlay.

8 Claims, 1 Drawing Sheet

THERAPEUTIC MATTRESS HAVING LUMBAR SUPPORT MEMBER

BACKGROUND OF THE INVENTION

The present invention relates to mattresses or more particularly to therapeutic mattresses having lumbar region support means.

It is well known in the art to provide mattress constructions which have a generally flat outer surface. These are typically comprised of an inner portion having an array of springs which are covered or encapsulated in a resilient fabric or rubbery material. The covered springs are then enveloped in an outer fabric material in a generally rectangular configuration. It is also known to provide a roll-up type of cushion bedding which finds particular use in such recreational sports as camping, hiking and the like. Typically, such cushions are mere rectangular sections of foam rubber which a camper unrolls on the ground to serve as a base for a sleeping bag. Neither of these configurations provide differential support for one's body weight as it is distributed while in a reclining position.

The present invention improves upon the aforesaid mattress designs by providing a mattress which adjusts to the contours and weight distribution of the body and additionally provides particular support for the lumbar portion of the spine.

SUMMARY OF THE INVENTION

The invention provides a mattress which comprises a substantially planar cushion of a relatively flexible, resilient material, having first and second major outer surfaces and a length and width in a preferably rectangular configuration; and a strip of a relatively soft, smooth elongated foam support adhered to one of said outer surfaces.

DETAILED DESCRIPTION OF THE PREFERRED EMBODIMENT

Figure 1:
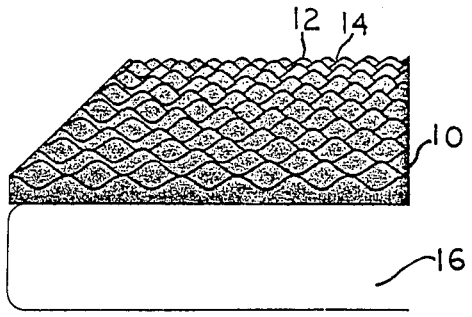
FIG. 1 shows the cushion material of this invention.
Figure 2:
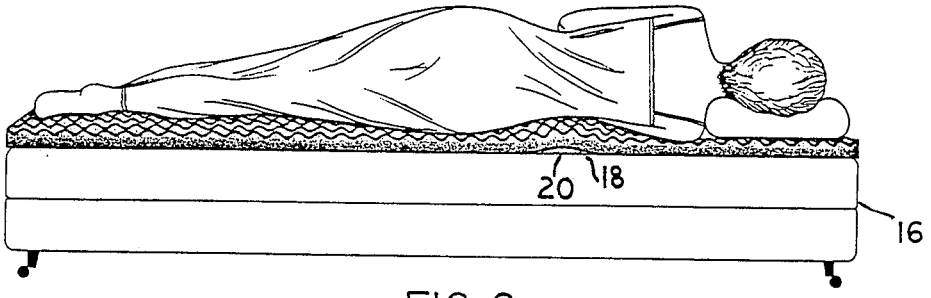
FIG. 2 shows the inventive mattress in use overlaying a second mattress.
Figure 3:
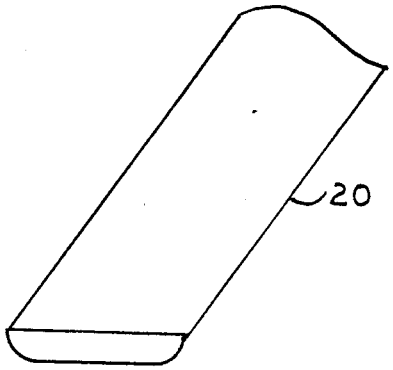
FIG. 3 shows a support member useful for the invention.

Referring now to the drawings, the mattress of the present invention has a substantially planar cushion member 10. One surface of the cushion preferably has many peaks 12 and valleys 14 in a dimpled configuration. In the preferred embodiment the cushion member comprises a foam rubber material such as urethane. In one prospective use, the cushion overlays a second mattress 16 although such is not necessary. The dimensions of the mattress 10 may be virtually any size desired, for example, the size of a typical single, double, queen size or king size mattress. The lowermost portion of the mattress has adhered thereto a lumbar support member 20 adhered at point 18 across the width of the cushion. This lumbar support member, as exemplified in FIG. 3, is a relatively soft, smooth, elongated, curvilinear member which merely adheres to the underside of the cushion. In the preferred embodiment, the lumbar support is a strip of soft urethane foam with one flat and one rounded surface. One can adjust the height of the support by shaving pieces off or gluing spare pieces of material onto the support. The support is adhered at the lumbar position of the user's spine. The combination of foamed cushion and lumbar support allows the mattress to adjust to the curvatures of the body and provides a fluid-like support without undue pressure. As shown in FIGS. 1 and 2, the mattress of this invention can additionally be used in association with a second underlying mattress 16. As such it can rejuvenate older mattresses or reduce motion in an underlying waterbed.

Although the invention has been exemplified herein as a preferred embodiment, it should be understood that various changes may be made to the invention without departing from the scope thereof.

What is claimed is:

1. A mattress of a size sufficient to support the body of a user in a lying down position, comprising a substantially planar cushion of a relatively flexible, resilient material, having top and underside surfaces having a length and width; and at least one strip of foam comprising a lumbar support fixedly and permanently adhered to the underside of the cushion across its width, perpendicular to its length, said strip having a dimension parallel to the length of the cushion that is substantially smaller than the length of the cushion, and being positioned at the location of the lumbar region of the spine of a user to thereby provide support for a user's spine.

2. The mattress of claim 1 wherein said cushion material comprises urethane foam.

3. The mattress of claim 1 wherein said cushion material comprises foam rubber.

4. The mattress of claim 1 wherein said support member comprises urethane foam.

5. The mattress of claim 1 wherein said support member comprises foam rubber.

6. The mattress of claim 1 wherein one of said surfaces has a plurality of peaks and valleys extending across said surface.

7. The mattress of claim 1 wherein said cushion is rectangular.

8. The mattress of claim 1 wherein said support has a flat surface and a curved surface.

* * * * *